US010683701B2

(12) United States Patent
Lenci

(10) Patent No.: US 10,683,701 B2
(45) Date of Patent: Jun. 16, 2020

(54) DEVICE FOR A LADDER

(71) Applicant: Marc S. Lenci, Mt. Vernon, NY (US)

(72) Inventor: Marc S. Lenci, Mt. Vernon, NY (US)

( * ) Notice: Subject to any disclaimer, the term of this patent is extended or adjusted under 35 U.S.C. 154(b) by 0 days.

(21) Appl. No.: 16/216,081

(22) Filed: Dec. 11, 2018

(65) Prior Publication Data

US 2019/0178035 A1 Jun. 13, 2019

Related U.S. Application Data

(63) Continuation-in-part of application No. 29/634,457, filed on Jan. 22, 2018, now Pat. No. Des. 872,879, and a continuation-in-part of application No. 29/634,461, filed on Jan. 22, 2018.

(60) Provisional application No. 62/597,610, filed on Dec. 12, 2017.

(51) Int. Cl.
*E06C 7/14* (2006.01)
*E06C 7/48* (2006.01)

(52) U.S. Cl.
CPC . *E06C 7/14* (2013.01); *E06C 7/48* (2013.01)

(58) Field of Classification Search
CPC . E06C 7/14; E06C 7/143; E06C 7/165; E06C 7/50; A47B 2220/0019; A47F 5/11
USPC ..... 248/174, 210, 238, 300, 459, 460
See application file for complete search history.

(56) References Cited

U.S. PATENT DOCUMENTS 1,463,585 A * 7/1923 Kellogg ..... G09F 1/04 40/584
2,012,117 A * 8/1935 Abraham ..... A47F 5/112 248/174
2,246,219 A * 6/1941 Nourse ..... A47F 5/112 248/174
2,294,641 A * 9/1942 Walters ..... A47F 5/112 211/126.16
2,911,133 A * 11/1959 Ruggieri ..... E06C 7/14 182/129
3,292,290 A * 12/1966 Potter ..... B65D 5/4225 40/124.09
4,077,595 A * 3/1978 Carter ..... E06C 7/14 248/210
4,291,798 A * 9/1981 Transport ..... A47G 1/141 206/45.24
4,330,102 A * 5/1982 Gebhardt ..... G09F 1/06 248/459
5,277,388 A * 1/1994 Denaro ..... A47F 5/112 206/45.25
5,647,453 A * 7/1997 Cassells ..... E06C 7/14 182/129
5,749,437 A * 5/1998 Weller ..... E06C 7/14 182/129

(Continued)

*Primary Examiner* — Terrell L McKinnon
*Assistant Examiner* — Michael McDuffle
(74) *Attorney, Agent, or Firm* — Andrew F. Young, Esq.; Lackenbach Siegel, LLP

(57) ABSTRACT

A device for use with a ladder may include a member that is transitionable between a first state in which the member is a generally planar surface and second state in which the member defines a pair of receptacles, each receptacle being configured to receive a leg of a ladder to secure the member to the ladder, the member defining a compartment between the receptacles in the second state. The member may be a foldable material having a unitary construction. The foldable material may include a plurality of fold lines to facilitate transitioning of the device to the second state.

1 Claim, 5 Drawing Sheets

(56) References Cited

U.S. PATENT DOCUMENTS

| | | | | |
|---|---|---|---|---|
| 5,988,383 | A * | 11/1999 | Armstrong | E06C 7/14 182/129 |
| 6,325,343 | B1 * | 12/2001 | Flagg | A47B 19/08 248/174 |
| 6,364,057 | B1 * | 4/2002 | Cornejo | E06C 7/006 182/106 |
| 6,467,577 | B1 * | 10/2002 | Charlebois, Jr. | E06C 7/14 182/121 |
| 6,587,022 | B1 * | 7/2003 | Devine | A45F 5/00 206/350 |
| 8,151,938 | B2 * | 4/2012 | Kinskey | A45C 5/00 182/129 |
| 8,561,954 | B2 * | 10/2013 | Padilla | E06C 7/14 182/122 |
| 10,293,634 | B2 * | 5/2019 | Sowder | B44D 3/18 |
| 2002/0070137 | A1 * | 6/2002 | Hedges | B25H 3/00 206/373 |
| 2003/0010570 | A1 * | 1/2003 | Murray | E04G 5/003 182/129 |
| 2012/0080393 | A1 * | 4/2012 | Eisman | A47B 43/00 211/86.01 |
| 2016/0177626 | A1 * | 6/2016 | Miller | E06C 7/14 396/419 |

* cited by examiner

DEVICE FOR A LADDER

CROSS REFERENCE FOR RELATED APPLICATIONS

This application relates to, and claims priority from, U.S. Prov. Ser. No. 62/597,610 filed Dec. 12, 2017, the entire contents of which are incorporated herein by reference.

This application additional relates to, and claims priority from U.S. Design Ser. No. 29/634,457 filed Jan. 22, 2018, the entire contents of which are incorporated herein by reference.

This application additional relates to, and claims priority from U.S. Design Ser. No. 29/634,461 filed Jan. 22, 2018, the entire contents of which are incorporated herein by reference.

FIGURE SELECTED FOR PUBLICATION

FIG. 2

BACKGROUND OF THE INVENTION

Field of the Invention

The present invention relates generally to a device for use with a ladder, in particular for providing a foldable and/or disposable protective covering and/or a compartment.

Description of the Related Art

As shown in FIG. 1, a ladder L is a vertical or inclined set of rungs or steps. As shown in FIG. 1, the ladder L that is depicted is a rigid ladder that is supported by being leaned against a surface, such as a vertical surface like a wall W. In particular, distal ends E of the ladder L are positioned against the wall W while the bottom ends (not shown) are placed on the ground (not shown).

Leaning a ladder at an appropriate angle against a wall surface is of great importance, particularly as there are often no other means of support. If a leaning ladder is placed at the wrong angle, the risk of a fall is greatly increased. Ideally, a ladder is leaned at an angle of 75.5°, which is neither too shallow or too steep. If a ladder is leaned at too steep of an angle, the ladder may fall backwards. Conversely, if the ladder leaned at too shallow an angle, the bottom of the ladder may slide.

Another challenge with a ladder that is supported by being leaned against a surface or wall is that leaning a ladder against a wall also has a tendency to scuff or mark up walls, which is particularly problematic when work is being done on an interior wall surface. As a ladder is moved or repositioned, the ladder may also mark up the wall against which it is placed. Further, ladders typically lack compartments in which tools may be held. Without an adequate compartment to hold tools, the tools are often haphazardly placed on a rung of the ladder and may thus fall.

Accordingly, there is a continuing need for devices that can facilitate maintaining a ladder in a leaning position and/or inhibit marking of the wall surface against which the ladder is to be leaned.

ASPECTS AND SUMMARY OF THE INVENTION

The present invention relates to a device for use with a ladder. In particular, the device may be secured to a leaning ladder and may provide a compartment for storing tools and the like.

A device for use with a ladder may include a member that is transitionable between a first state in which the member is a generally planar surface and second state in which the member defines a pair of receptacles, each receptacle being configured to receive a leg of a ladder to secure the member to the ladder, the member defining a compartment between the receptacles in the second state. The member may be a foldable material having a unitary construction. The foldable material may include a plurality of fold lines to facilitate transitioning of the device to the second state.

The member may have a length and a width in the unfolded state. The member may include a first segment that is adjacent to a second segment, a first fold line disposed along the width between the first and the second segment; a second segment that is adjacent to a third segment, a second fold line disposed along the width between the second segment and the third segment; a third segment that is adjacent to a fourth segment, a third fold line disposed along the width between the third segment and the fourth segment; a fourth segment that is adjacent to a fifth segment, a third fold line disposed along the width between the fourth segment and the fifth segment; the second segment including a fourth fold line extending along the length and a fifth fold line extending along the length, the fourth and the fifth fold lines defining a first leaf and a second leaf, the first and second leaves being generally opposed to one another and being foldable toward one another along the respective fourth and fifth fold lines, the first leaf defining a first opening and the second leaf defining a second opening, the second segment including a third opening being disposed at a midpoint along the width; the fifth segment including opposing third and fourth leaves, the third and fourth leaves being defined by fold lines extending along the length, the third and fourth leaves including a third opening and a fourth opening, the third leaf including a first tab and the fourth leaf including a second tab, the first tab being securable within the first opening, the second tab being securable within the second opening, the fifth segment including a third tab disposed at a midpoint along the width at a distal edge; and a cutout region extending from the third fold line and having opposing edges that are along lines extending along lengths of the sixth and seventh fold lines, the cut out region including a fourth tab, a fifth tab, the third and fourth tabs being generally opposing, and a centrally disposed sixth tab, the cutout region being rotatable to be secured against the fifth segment such that the third and fifth tabs are aligned with one another and are insertable into the third opening of the second segment, the third tab being securable within the third opening and the fourth tab being securable within the fourth opening.

The above and other aspects, features and advantages of the present invention will become apparent from the following description read in conjunction with the accompanying drawings, in which like reference numerals designate the same elements.

BRIEF DESCRIPTION OF THE DRAWINGS

A further understanding of the present invention can be obtained by reference to a preferred embodiment set forth in the illustrations of the accompanying drawings. Although the illustrated preferred embodiment is merely exemplary of methods, structures and compositions for carrying out the present invention, both the organization and method of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present disclosure, reference is now made to the following drawings in which.

DETAILED DESCRIPTION

Figure 1:
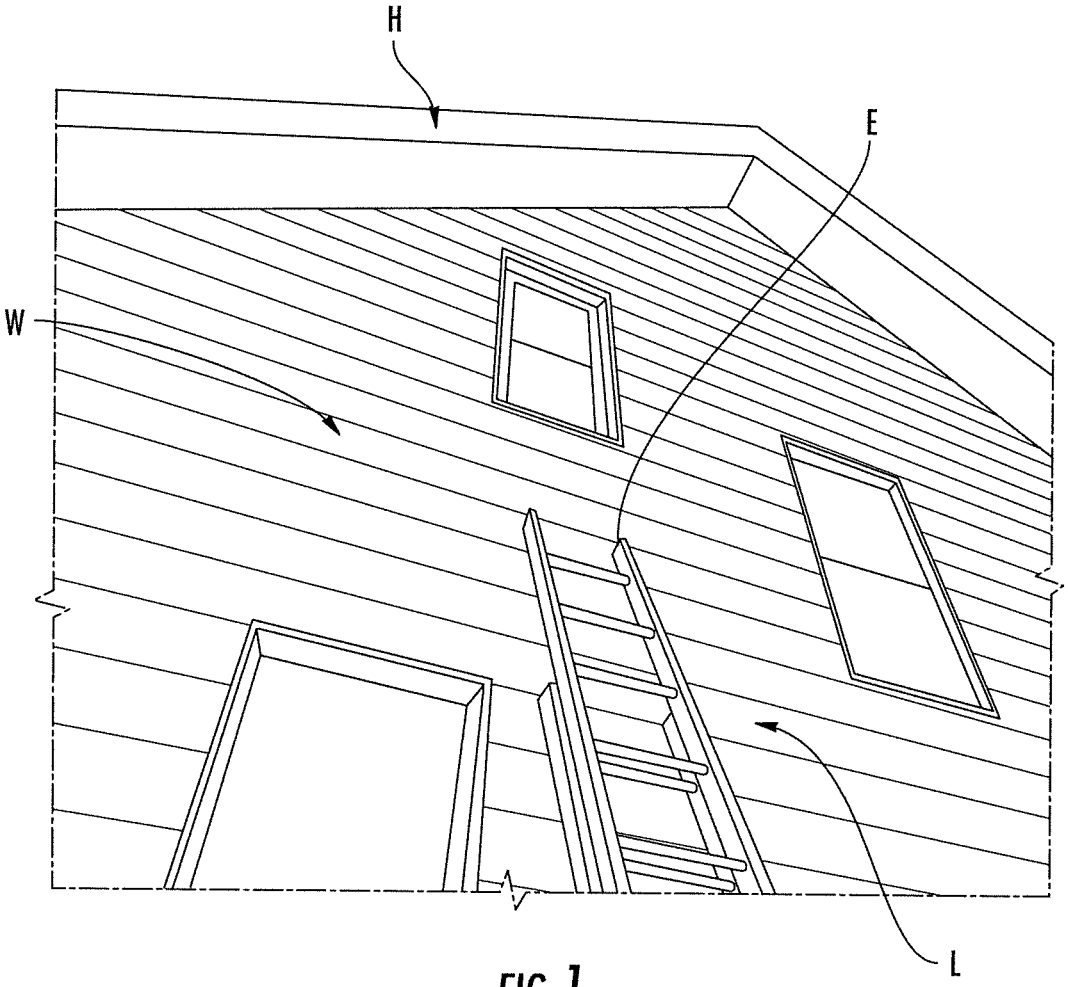
FIG. 1 (PRIOR ART)
FIG. 1 is a perspective view of a prior art ladder shown in use.

As required a detailed illustrative embodiment of the present disclosure is disclosed herein. However, techniques, systems, compositions and operating structures in accordance with the present disclosure may be embodied in a wide variety of sizes, shapes, forms, and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein, which define the scope of the present disclosure.

Reference will now be made in detail to several embodiments of the disclosure that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, below, etc., or motional terms, such as forward, back, sideways, transverse, etc. may be used with respect to the drawings. These are similar directional terms should not be construed to limit the scope of the disclosure in any manner.

A ladder device 100 in accordance with the present disclosure for use with a ladder L such as that shown in FIG. 1 will now be described.

Figure 2:
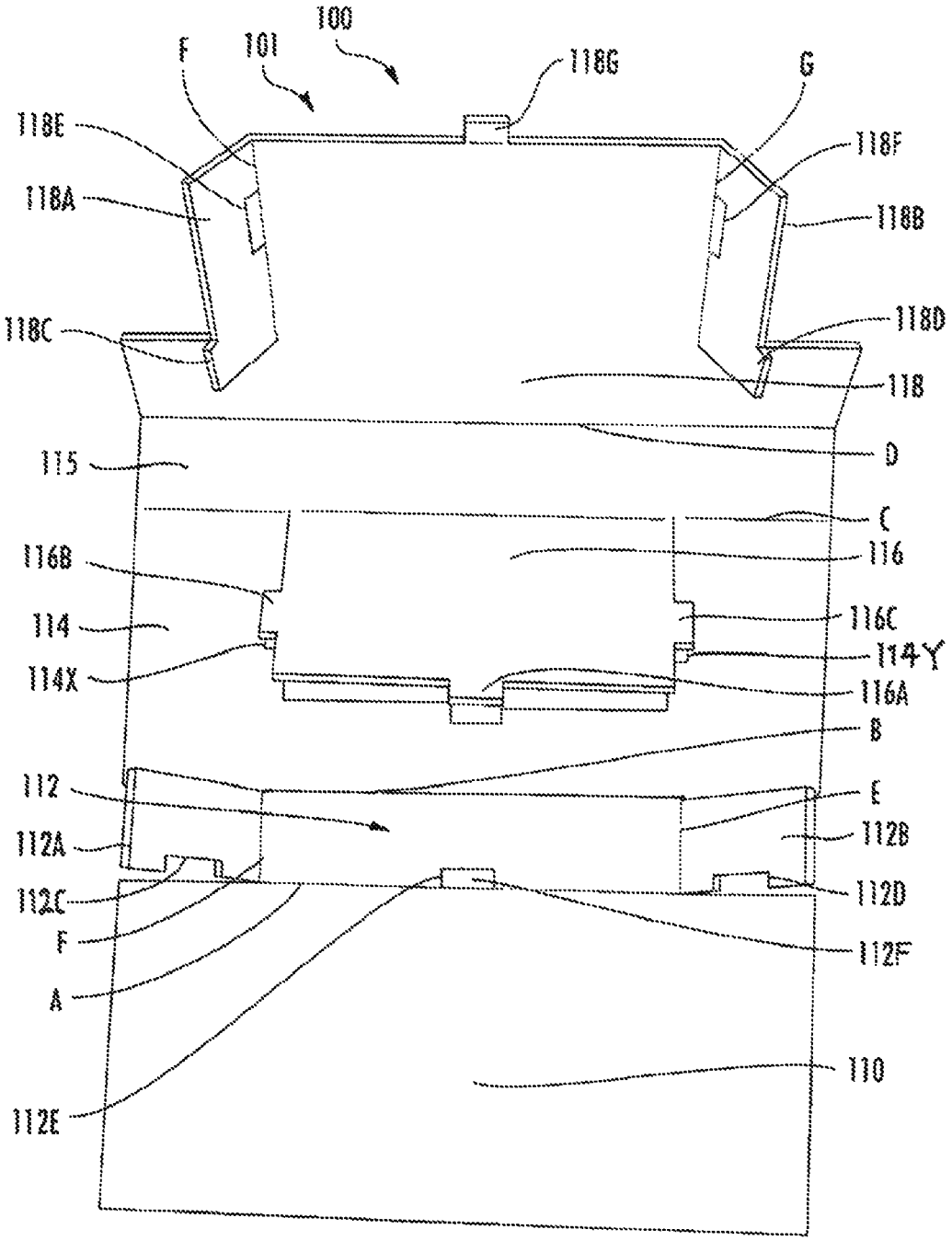
FIG. 2 is a perspective view of a device for use with a ladder shown in an unfolded state.
Figure 3:
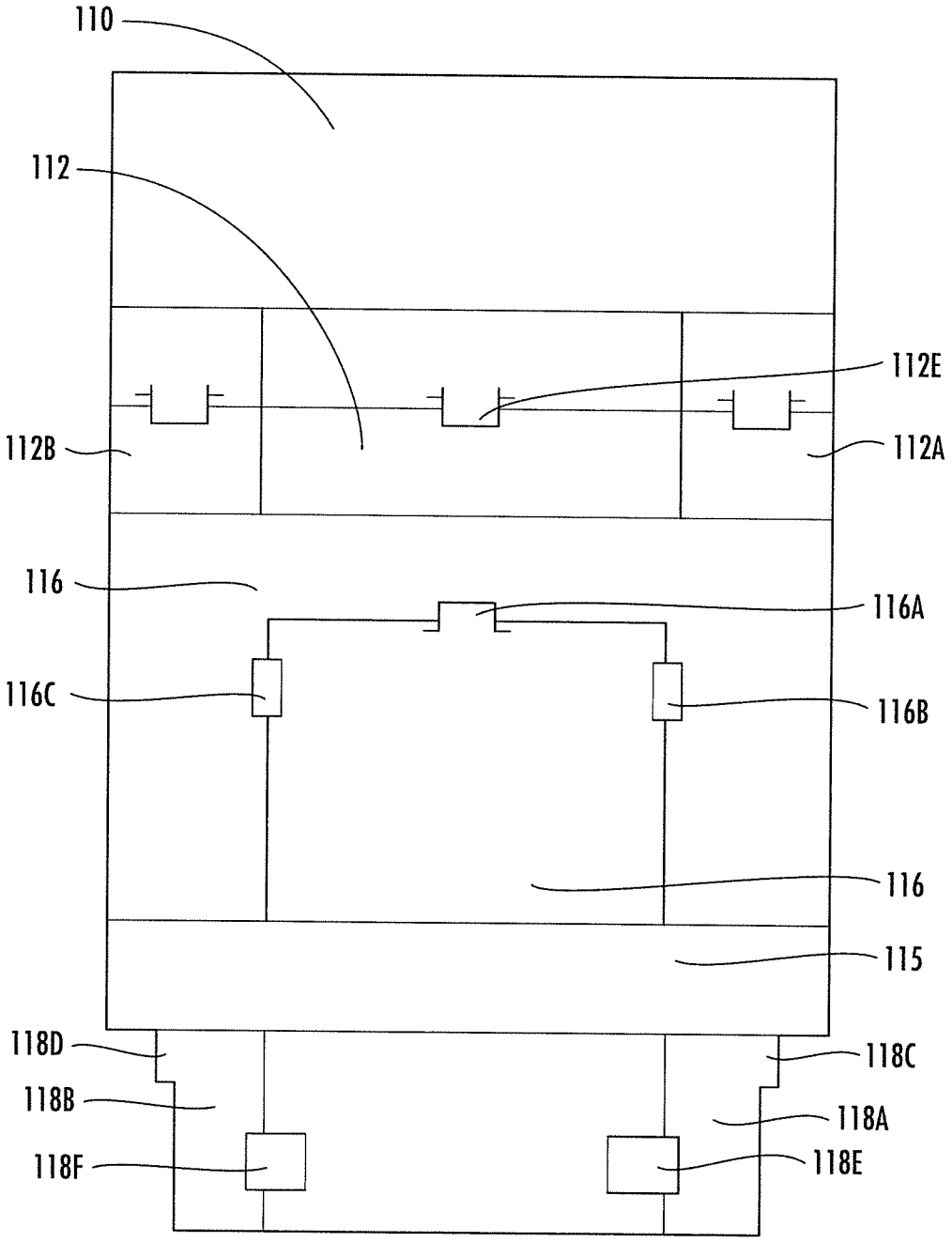
FIG. 3 is a schematic view of the device of FIG. 2.

As shown best in FIGS. 2-3, the ladder device 100 may include a member 101 that may be transitionable between a generally planar or flat state and a folded or assembled state. The member 101 may be formed from a unitary construction and may be a foldable material that may include a plurality of foldable segments that may be folded prior to use such that it may be used with the ladder L. Advantageously, since the ladder device 100 may be folded prior to use, it may also be stored in an unfolded state that is relatively flat which facilitates easier storage and transportation of the ladder device 100.

As shown in FIGS. 2-3, the ladder device 100 is shown in a substantially unfolded state. The ladder device 100 may be formed from any suitable material including a paperboard or cardboard material that although substantially rigid may be folded. Advantageously, this means that the ladder device 100 may be easily stored and is relatively cheap, and thus disposable after use.

Further, the ladder device 100 may include a plurality of segments that may be folded to relative to one another. In particular, the ladder device 100 may include a first segment 110 that is adjacent to a second segment 112. The first segment 110 may be folded relative to the second segment 112 relative to fold line A extending widthwise. The second segment 112 may be adjacent to a third segment 114 relative to fold line B extending widthwise along the width of the device 100. The third segment 114 may be adjacent to a fourth segment 115. The third segment 114 may be folded relative to the fourth segment 115 along a fold line C extending widthwise along the width of the device 100. The fourth segment 115 may be adjacent to a fifth segment 118. The fourth segment may be folded relative to the fifth segment 116 along a fold line D extending widthwise along the width of the device 100.

The second segment 112 may include two opposing leaves 112A and 112B that fold inward along respective fold lines F and E. Each of the leaves 112A and 112B may include an opening 112C and 112D, respectively. A tab 112E may be formed within the second segment 112 such the tab 112E may be pushed out to expose an opening 112F within the second segment 112.

A cutout region 116 may be disposed in the third segment 114 and the fourth segment 115. In particular, the cutout region 116 may be formed a distance away from the fold line A and may extend to fold line D. The cutout region 116 may thus be folded relative to fold line D and may be rotated to abut against the fifth segment 118 and secured thereto. In particular, the cutout region 116 may include tabs 116A, 116B, and 116C. The tab 116A may be aligned with a tab 118G of the fifth segment 118 when the cutout region 116 is positioned against the fifth segment 118. Both of the tabs 116A and 118G may be securely received within the opening 112F, and the tab 112E may facilitate frictionally maintaining the tabs 116A and 118G within the opening 112F.

The tabs 116B and 116C may be inserted into respective openings 118E and 118F of the fifth segment 118 when opposing sides 118A and 118B of the fifth segment 118 are folded along fold lines F and G, respectively, toward one another and are generally orthogonal relative the surface of the fifth segment 118. Further, when the fifth segment 118 is rotated towards the third segment 114, the opposing sides 118A and 118B may be secured to the third segment 114 as tabs 118C and 118D of the respective opposing sides 118A and 118B are inserted into the openings 114X and 114Y that are formed by the outline of the cutout region 116 from the third region 114. The frictional interaction between the tabs 118C and 118D within the respective openings 114X and 114Y maintains the opposing sides 118A and 118B in a generally orthogonal orientation relative to the third segment 114. Further, the tabs 116B and 116C may be frictionally secured within respective openings 112C and 112D that are formed in leaves 112A and 112B, respectively.

A method of folding the device 100 such that it may be used with the ladder L will now be described. It should be understood that the steps described herein are in no particular order and that some steps may be performed in alternative orders.

First, the cutout region 116 may be folded toward the fifth segment 118 and the tabs 118C and 118D may be secured within respective ones of the openings 118E and 118F. Then, with the opposing sides 118A and 118B generally orthogonal relative to the plane of the fifth segment 118, the tabs 118C and 118D may be inserted into 114X and 114Y, respectively, of the third segment 114. Thereafter, the second segment 112 may be folded along fold line A toward the first segment 110, and leaves 112A and 112B may be rotated to abut against respective ones of the opposing sides 118A and 118B. Thereafter, the tabs 118C and 118D of respective ones of the opposing sides 118A and 118B may be releasably secured within respective ones of the openings 112C and 112D of the leaves 112A and 112B such that the tabs 116A and 118G are maintained within the opening 112F of the second segment 112, and the segment 112, the cutout portion 116, and the opposing sides 118A and 118B form respective sides of a rectangular box.

Figure 4:
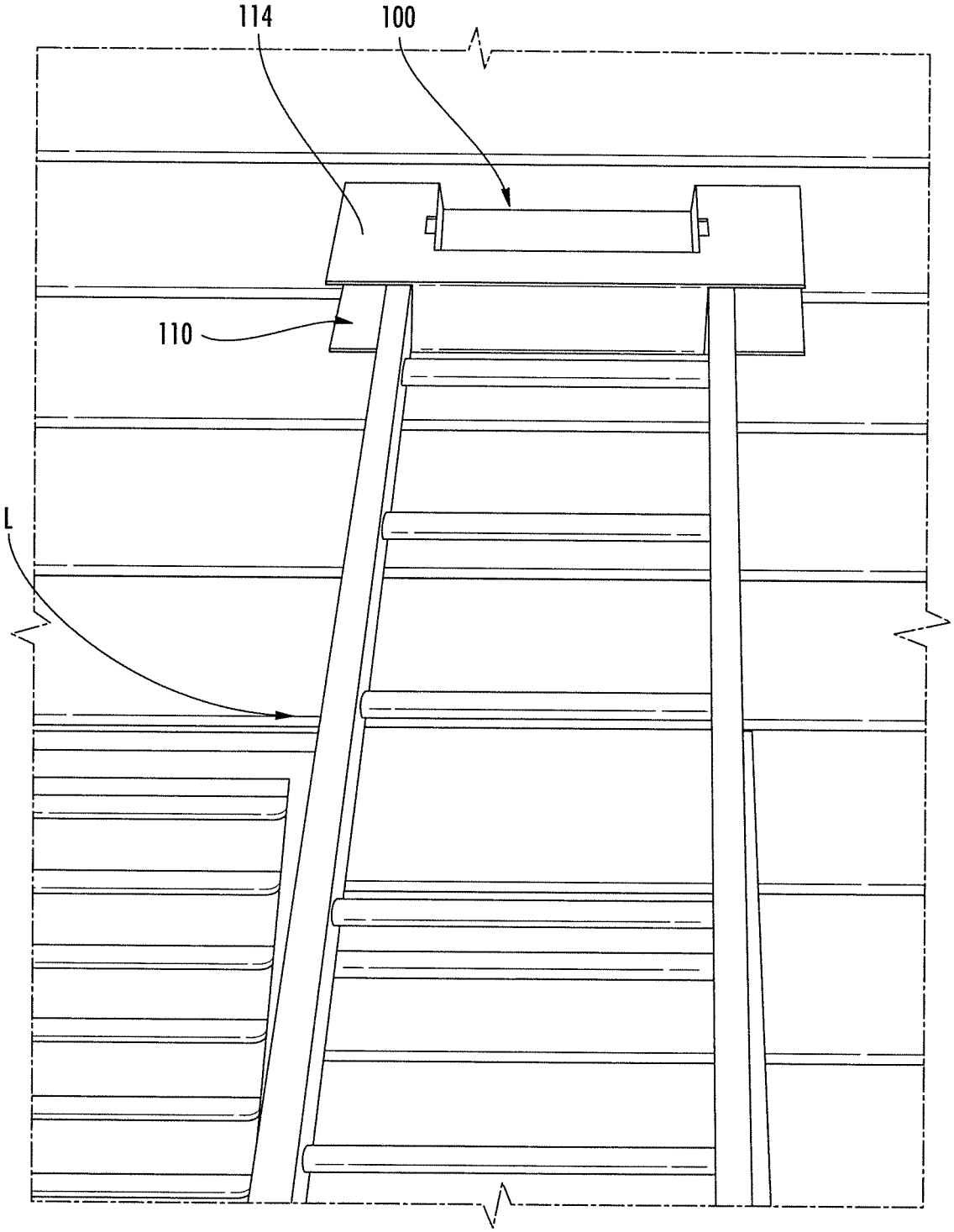
FIGS. 4-5 are view of the device of FIG. 2 shown in use.
Figure 5:
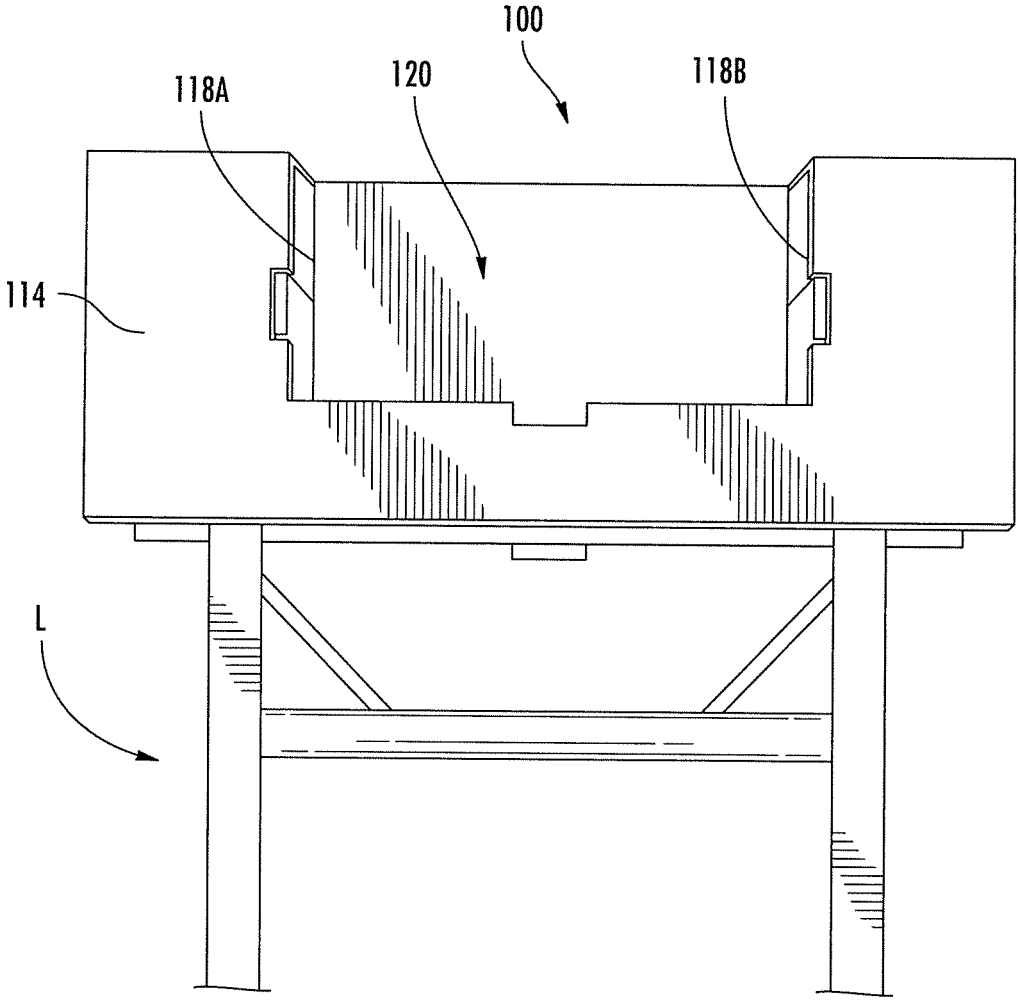

A method for using the device 100 with the ladder L will now be described. Now with the device 100 assembled, as shown in FIGS. 4-5, the device 100 may be coupled to the ladder L. In particular, when assembled, the third segment 114, the fourth segment 115, and the fifth segment 118, and the opposing sides 118A and 118B each form a generally rectangular region or receptacle in which the opposing edges E of the legs of the ladder L can be snuggly received and positioned. The first segment 110 may be positioned on a back of the ladder L and the third segment 114 may be positioned at the front of the ladder. Advantageously, the front portion of the assembled device 100 has a compartment 120 which can be used to hold various tools or supplies, for example.

Although the member 101 is described as a unitary construction and being a foldable member, it is within the scope and spirit of this disclosure that instead of having fold lines that may be replaced by hinges such that the various segments of the member 101 described herein may instead be hingedly coupled to one another.

Having described at least one of the preferred embodiments of the present invention with reference to the accompanying drawings, it is to be understood that such embodiments are merely exemplary and that the invention is not limited to those precise embodiments, and that various changes, modifications, and adaptations may be effected therein by one skilled in the art without departing from the scope or spirit of the invention as defined in the appended claims. The scope of the invention, therefore, shall be defined solely by the following claims. Further, it will be apparent to those of skill in the art that numerous changes may be made in such details without departing from the spirit and the principles of the invention. It should be appreciated that the present invention is capable of being embodied in other forms without departing from its essential characteristics.

It is additionally recognized that the disclosed shape and form of the invention may be modified into a different shape and form (multiple) while continuing to function in the claimed and disclosed manner, such that those of skill in the art will recognize that the same function may be achieved by differently shaped and differently formed devices within the scope and spirit of the present invention. For example, the enclosed perform and form may be prepared with curved edges, curved and interlocking tab members, longer or shorter shapes, additional holes or sections for holding devices to use on a ladder, or for receiving (in pockets etc.) additional padding or bumper members for further cushioning. All these alternative shapes will be recognized within the scope of the present invention such that differing shapes and forms will be recognized as suitable for the present invention and may be separately protectable.

What is claimed is:

1. A device, for use with a ladder comprising:

a member that is transitionable between a first state in which the member is a generally planar surface and second state in which the member defines a pair of receptacles, each receptacle being configured to receive a leg of a ladder to secure the member to the ladder, the member defining a compartment between the receptacles in the second state;

wherein, the member has a length and a width, and the member includes:

a first segment that is adjacent to a second segment, a first fold line disposed along the width between the first segment and the second segment;

said second segment adjacent to a third segment, a second fold line disposed along the width between the second segment and the third segment;

said third segment adjacent to a fourth segment, a third fold line disposed along the width between the third segment and the fourth segment;

said fourth segment adjacent to a fifth segment, a fourth fold line disposed along the width between the fourth segment and the fifth segment;

the second segment including a fourth fold line extending along the length, the fourth and the fifth fold lines defining a first leaf and a second leaf, the first and second leaves being generally opposed to one another and being foldable toward one another along the respective fourth and fifth fold lines, the first leaf defining a first opening and the second leaf defining a second opening, the second segment including a third opening being disposed at a midpoint along the width;

the fifth segment including opposing third and fourth leaves, the third and fourth leaves being defined by sixth and seventh fold lines extending along the length, the third and fourth leaves including a third opening and a fourth opening, the third leaf including a first tab and the fourth leaf including a second tab, the first tab being securable within the first opening, the second tab being securable within the second opening, the fifth segment including a third tab disposed at a midpoint along the width at a distal edge; and a cutout region extending from the third fold line and having opposing edges that are along lines extending along lengths of the sixth and seventh fold lines, the cut out region including a fourth tab, a fifth tab, the third and fourth tabs being generally opposing, and a centrally disposed sixth tab, the cutout region being rotatable to be secured against the fifth segment such that the third and fifth tabs are aligned with one another and are insertable into the third opening of the second segment, the third tab being securable within the third opening and the fourth tab being securable within the fourth opening.

* * * * *